US005392618A

United States Patent [19]

Livingston et al.

[11] Patent Number: 5,392,618

[45] Date of Patent: Feb. 28, 1995

[54] LOW COST LIQUID CHEMICAL DISPENSER FOR LAUNDRY MACHINES

[75] Inventors: James W. Livingston, Santa Cruz; Ralph W. Hiesey, Boulder Creek, both of Calif.

[73] Assignee: Diversey Corporation, Ontario, Canada

[21] Appl. No.: 121,306

[22] Filed: Sep. 14, 1993

[51] Int. Cl.[6] ..... B08B 3/02

[52] U.S. Cl. ..... 68/12.02; 68/12.18; 137/266

[58] Field of Search ..... 68/12.02, 12.18, 17 R, 68/207; 364/478, 502; 137/266, 567, 566; 222/59; 8/158

[56] References Cited

U.S. PATENT DOCUMENTS

| | | | |
|---|---|---|---|
| 4,756,321 | 7/1988 | Livingston . | |
| 5,014,211 | 5/1991 | Turner et al. . | |
| 5,195,338 | 3/1993 | Russo | 68/12.18 |
| 5,207,080 | 5/1993 | Reinhard | 68/17 R |
| 5,208,330 | 5/1993 | Chabaris | 8/158 |
| 5,253,379 | 10/1993 | Dusamos et al. | 68/12.18 |

FOREIGN PATENT DOCUMENTS

| | | | |
|---|---|---|---|
| 232518 | 11/1987 | Germany | 68/12.18 |

*Primary Examiner*—Frankie L. Stinson

*Attorney, Agent, or Firm*—Flehr, Hohbach, Test, Albritton & Herbert

[57] ABSTRACT

An apparatus for dispensing liquid chemicals into a laundry machine is described. An operator interface with a small number of programming/execution buttons is provided. The programming/execution buttons are pressed to define a liquid dispensing program which is stored as a compact set of instructions which can be executed with minimal computing power. Each step of the liquid dispensing program is defined by either delay information or chemical volume dispensing information, and a synchronization flag. When enabled, the synchronization flag in a program step causes the apparatus to wait for a synchronization signal before executing the program step. Synchronization signals are produced by a sensor that identifies water flows either into or from the laundry machine. A microcontroller, in conjunction with a program execution module, executes the liquid dispensing program by waiting through time delay periods dictated by the cycle delay information, generating pump activation commands based upon the chemical volume dispensing information, and waiting for a synchronization signal for each program step that includes a synchronization flag. A pump interface receives the pump activation commands and forces a defined volume of liquid chemicals from a chemical container into a receptacle positioned on the laundry machine.

13 Claims, 5 Drawing Sheets

LOW COST LIQUID CHEMICAL DISPENSER FOR LAUNDRY MACHINES

The present invention relates generally to chemical dispensing systems used in laundry washing machines. More particularly, the present invention relates to a laundry machine chemical delivery system that includes low cost and compact chemical dispensing program storage and program execution.

BACKGROUND OF THE INVENTION

Small commercial laundry or clothing washer machines, for loads of less than 50 pounds or less than 25 kilograms, typically require three chemicals to be dispensed into the washer during a sequence of three or more bath cycles. The chemical dispensers for most commercial laundry machines are provided, usually at little or no cost to the customer, by the chemical supply company that provides the supplies for each particular laundry machine. However, since most small commercial laundry machines use relatively small amounts of chemicals, the amount of revenues generated for the sale of such chemicals is also small, and therefore it is important that the chemical dispensers for such machines be inexpensive.

One factor that makes many prior art chemical dispensers expensive, as well as difficult to install, is the need to connect the chemical dispenser to the sequence controller of the laundry machine. The sequence controller, which is standard equipment on industrial and commercial washers, produces a sequence of output signals that cause water to fill the machine's bath, to agitate the batch contents, to drain the bath, and to repeat that process several times at various intervals.

Another factor that makes prior art chemical dispensers expensive is the operator interface. The operator interface must facilitate the execution of several standard functions, including calibrating each of the dispenser's pumps accurately and quickly, programming the dispenser to perform sequences of chemical dispensing steps in coordination with the washer machine's wash cycles, and activating the dispenser to run a particular programmed sequence of dispensing steps when running the washer machine. The hardware and software required to execute these functions should be minimized to reduce the expense of the chemical dispenser system.

It is a general object of the present invention to provide a low cost liquid chemical dispenser.

It is a related object of the invention to provide a method and apparatus that requires minimal memory space to store a liquid dispensing program.

It is another object of the invention to provide a method and apparatus that requires minimal computing power to execute a liquid dispensing program.

It is another object of the invention to provide an operator interface that is physically compact.

It is still another object of the invention to provide an operator interface that is easy to program.

It is a related object of the invention to provide an operator interface that utilizes chemical calibration units for convenient operator programming.

It is a related object of the invention to provide delay time units for convenient operator programming.

It is another object of the invention to eliminate the need to electrically connect a chemical dispenser to a laundry machine's sequence controller.

SUMMARY OF THE INVENTION

In summary, the present invention is a liquid chemical dispenser for dispensing liquid chemicals into a laundry machine. An operator interface with a small number of programming/execution buttons is provided. The programming/execution buttons are pressed to define a liquid dispensing program that is stored as a compact set of instructions that can be executed with minimal computing power. The liquid dispensing program includes cycle delay information, chemical volume dispensing information, and a synchronization flag to wait for a synchronization signal produced by a simple sensor that identifies the termination of a laundry cycle. A microcontroller, in conjunction with a program execution module, executes the liquid dispensing program by establishing a time delay period based upon the cycle delay information, by generating pump activation commands based upon the chemical volume dispensing information, and by responding to the synchronization signal. A pump interface receives the pump activation commands and forces a defined volume of liquid chemicals from a chemical container into a receptacle positioned on the laundry machine.

BRIEF DESCRIPTION OF THE DRAWINGS

For a better understanding of the nature and objects of the invention, reference should be made to the following detailed description taken in conjunction with the accompanying drawings, in which.

DETAILED DESCRIPTION OF THE PREFERRED EMBODIMENTS

Figure 1:
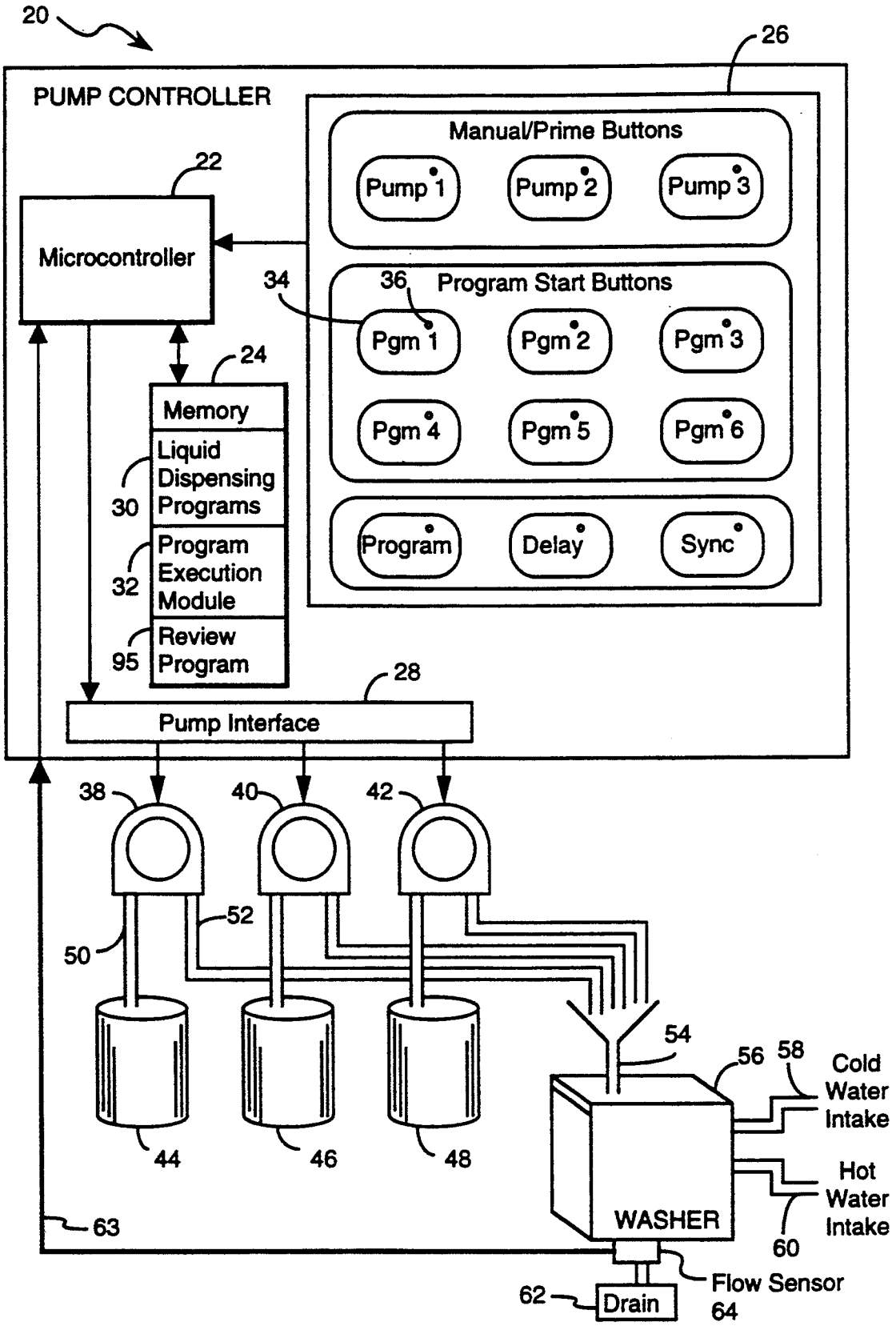
FIG. 1 depicts a liquid chemical dispensing apparatus in accordance with the invention; in particular, the figure depicts the electronic hardware and software elements of the liquid chemical dispensing apparatus, its operator interface, and its connections to chemical dispensing pumps and to a laundry machine.

Referring to FIG. 1, a low cost liquid chemical dispenser control apparatus 20 is disclosed. The apparatus 20 includes four major components: a microcontroller 22, a memory unit 24, an operator interface 26, and a pump interface 28. As will be more fully described below, the memory unit 24 stores liquid dispensing programs 30 that are executed in conjunction with microcontroller 22 by a program execution module 32.

The operator interface 26 is a compact unit with a minimum number of operating buttons. Preferably, each button 34 includes a Light Emitting Diode (LED) 36.

The operator interface 26 of FIG. 1 includes twelve buttons 34. The top row of buttons are manual/prime buttons identified as Pump 1, Pump 2, and Pump 3. As will be fully described below, these buttons are used to (A) calibrate liquid chemical pumps 38, 40, 42, and (B) to manually operate the pumps. The next two rows of buttons are program start buttons identified as Pgm 1, Pgm 2, Pgm 3, Pgm 4, Pgm 5, Pgm 6. As will be fully described below, these buttons are used to initiate both the programming and execution of a dispensing program. The final row of buttons are program input buttons identified as Program, Delay, and Sync. As will be fully described below, these buttons are used to define the various dispensing programs of the chemical dispenser control apparatus 20.

The pump interface 28 receives signals from the microcontroller 22 and generates appropriate actuation signals for pumps 38, 40, and 42. The pumps are respectively coupled to liquid chemical containers 44, 46, and 48, which hold liquid chemicals commonly used in laundry washing processes. Each pump draws liquid chemical from a corresponding liquid chemical container through intake conduit 50 and forces it through output conduit 52 into a chemical receptacle 54 positioned at a laundry machine 56.

The laundry machine 56 includes a cold water intake 58 and a hot water intake 60. Coupled to the drain port of the laundry machine 56 or drain 62 is a flow sensor 64. The flow sensor 64 provides a synchronization signal over line 63. As will be more fully described below, the synchronization signal serves as the only feedback from the laundry machine 56. In other words, a simple flow sensor 64 is substituted for the expensive and complicated sequence controller interface used in the prior art.

The flow sensor 64 can be an optical sensor (the preferred implementation), an electrical voltage sensor, or a hydraulic sensor. Since the drain valve may be powered to an open position with a solenoid valve or powered to a closed position with a motor driven valve, the flow sensor 64 can be an electrical sensor coupled to the solenoid valve or motor such that the flow sensor produces one signal when the drain valve is open and produces a different signal when the drain valve is closed. The status of the drain valve may also be assessed by using an optical sensor as the flow sensor 64. For instance, the optical sensor may be positioned such that when the valve is closed the optical sensor receives a light signal and when the valve is open the optical sensor does not receive a light signal. Alternately, a hydraulic sensor could be used to detect the actual flow of water through the drain 62.

One skilled in the art will be able to construct most of the elements described up to this juncture. In particular, the interaction between a pump interface 28, pumps (38, 40, 42) and a laundry machine 56 are known in the art. Also generally known in the art is the interaction between a microcontroller 22, a memory unit 24, and an operator interface 26. Attention presently turns to those aspects of the microcontroller 22, memory unit 24, and operator interface 26 which are not known in the art. In particular, attention turns to the liquid dispensing programs 30 and program execution module 32 stored in the memory unit. Attention also focuses on the compact operator interface 26 used in accordance with the invention.

Operation of the present invention will initially be disclosed by describing the operation of the operator interface 26. The corresponding program storage and program execution will be subsequently described. This disclosure will then be illuminated with a specific example.

The manual/prime buttons are used to calibrate the dispensing of liquid chemicals. This calibration process begins by pressing the program button at the bottom of the operator interface 26. When any button is depressed, the corresponding LED for the button is activated to provide the user with an indication that the input has actually been received. However, the LED associated with the program button will only go on after a time delay, of say five seconds, to reduce the possibility of accidentally entering the programming mode.

After the programming mode is entered, Pump 1 can be calibrated by pressing down the Pump 1 button. This sends a signal to microcontroller 22 that generates a pump activation signal that is conveyed to pump interface 28. Pump interface 28 activates pump 38, which draws liquid chemical from container 44 through intake conduit 50, forcing it through output conduit 52, into receptacle 54. The Pump 1 button is pressed again after a preselected amount of chemical is dispensed, such as five ounces. In other words, the user will measure the amount of chemical dispensed at the receptacle 54. When the preselected amount of chemical is dispensed, the button is pressed to stop the pump. The time required to dispense the liquid will then be stored by the microcontroller 22, in an EEPROM within the memory unit 24. The time required to dispense the desired or preselected amount of liquid will be referred to as a time calibration period. In the future, if the Pump 1 button is depressed, the pump will automatically run for the time calibration period. The calibration of Pump 2 and Pump 3 is achieved in the same manner. Pump calibration is preferably performed at periodic intervals. Calibration should be performed after a conduit change or other change of physical equipment associated with a pump.

The time calibration period is preferably used by the microcontroller 22 to establish a chemical calibration unit, which is subsequently used in defining other liquid dispensing programs. The chemical calibration unit is a volume value corresponding to the amount of chemical detergent dispensed in the time calibration period.

Preferably, a fraction of the time calibration period is used to establish the chemical calibration unit. For instance, assume that the chemical dispenser control apparatus of the invention comes with instructions to measure a specific chemical calibration volume, for example, five ounces of liquid chemical. Further assume that it takes ten seconds to dispense this amount of liquid chemical. The time period of ten seconds is the time calibration period. A chemical calibration unit is preferably defined as the liquid volume dispensed in a fraction of the time calibration period. If the fraction is 1/10, then the chemical calibration unit corresponds to 0.5 ounces of liquid chemical.

In the present invention, the amount of chemical to be dispensed by a program is represented by a number of chemical calibration units, instead of by a pump run time, because the chemical calibration unit is more intuitive for the individual programming the liquid chemical dispenser control apparatus. In the U.S., the calibration unit will typically be 0.5 ounces or 1.0 ounce, while in most other countries, the calibration unit will be 10 ml. The use of the chemical calibration unit in the programming mode will now be described.

The operator interface 26 includes six programming buttons. Each button is used to program and subsequently activate a liquid dispensing program. Each liquid dispensing program includes three primary states. The first state is the delay state. As its name implies, in this state, a delay is imposed so that water may enter the machine or a predetermined temperature may be reached. The second state is the dispense state. During the dispense state, liquid chemical is dispensed into the machine 56. In particular, a multiple of the chemical calibration units is dispensed, as will be more fully described below. The third state is the wait state. In the wait state, the microcontroller waits for a signal from the flow sensor.

A liquid dispensing program 30 is a sequence of delay, dispense, and wait states corresponding to a desired wash cycle. The liquid dispensing program 30 operates "on top of" the normal operation of the washer 54.

By way of a brief example, if a standard washing machine 56 is turned on, it will automatically begin to fill with water. The delay state of a liquid dispensing program 30 will provide a delay period to allow the washing machine to fill up. After the delay period is expired, the dispense state will be activated to dispense a programmed amount of liquid chemical, for instance, detergent. After the dispense state, the wait state will be invoked while the machine washes the laundry. The wait state will terminate after it senses the emptying of the tub (not shown) in the machine 56. In other words, after the washing is completed, the tub will be emptied. The flow sensor 64 will recognize when the drain is receiving water from the emptied tub. The sensor gives a valid signal after five seconds of water flow in the preferred embodiment. At this point, the washing machine will automatically begin another cycle, for instance a bleach cycle, and a new delay state will be invoked to allow the tub to finish draining and then to refill. The process then proceeds through several cycles.

Establishing a liquid dispensing program 30, with its delay, dispense, and wait states will now be described with an abbreviated example. Suppose that the chemical dispenser control apparatus 20 is to be programmed to achieve the following functions: (1) delay for two minutes while the machine 56 tub fills, (2) dispense three ounces of detergent, and (3) shut off after the tub is emptied.

The programming process for such a sequence of operations begins by pressing the program button on the operator interface 26. Afterwards, a program button number is pressed, for example the button Pgm 1. Since the first step of the example program is a delay state, the Delay button is pressed. This will cause the Delay button LED to flash at a period interval. Each flash of the Delay button LED corresponds to one time delay unit. In the preferred embodiment, each flash of the LED corresponds to a time delay unit of thirty seconds. Thus, to achieve a delay state of 2 minutes, the user will allow the LED to flash four times. Then, by pushing the Delay button a second time, the flashing will stop and a time delay count of four, equivalent to two minutes (time delay unit (30 sec)×time delay count(4)=120 sec), will be stored. Note that the LED on each button flashes or "blinks" at a steady rate (e.g., one blink per second) until the button is pushed a second time.

The dispense step is programmed in a similar fashion. If the chemical from pump 1 is to be dispensed, then the pump 1 button is depressed. The LED corresponding to this button will flash until the pump button is pushed again. The programmer lets the LED flash once for every chemical calibration unit that is to be dispensed. In the example provided above, each chemical calibration unit was equivalent to 0.5 ounces. Thus, to dispense three ounces of liquid chemical from pump 1, the pump button LED will be allowed to flash six times. After the sixth flash, the pump button is pressed once again, and a time calibration count value of 6 is stored.

Programming the wait state merely requires pressing the sync button. That is, by pressing the sync button until its LED comes on, the wait state is invoked and will be executed in the liquid dispensing program 30. Most wait states are followed by a delay state, but either a dispense step or a delay step can be programmed to follow a wait state.

In the foregoing manner, multiple customized liquid dispensing programs may be established. Execution of a program may later be invoked simply by pressing one of the numbered program buttons.

Figure 2:
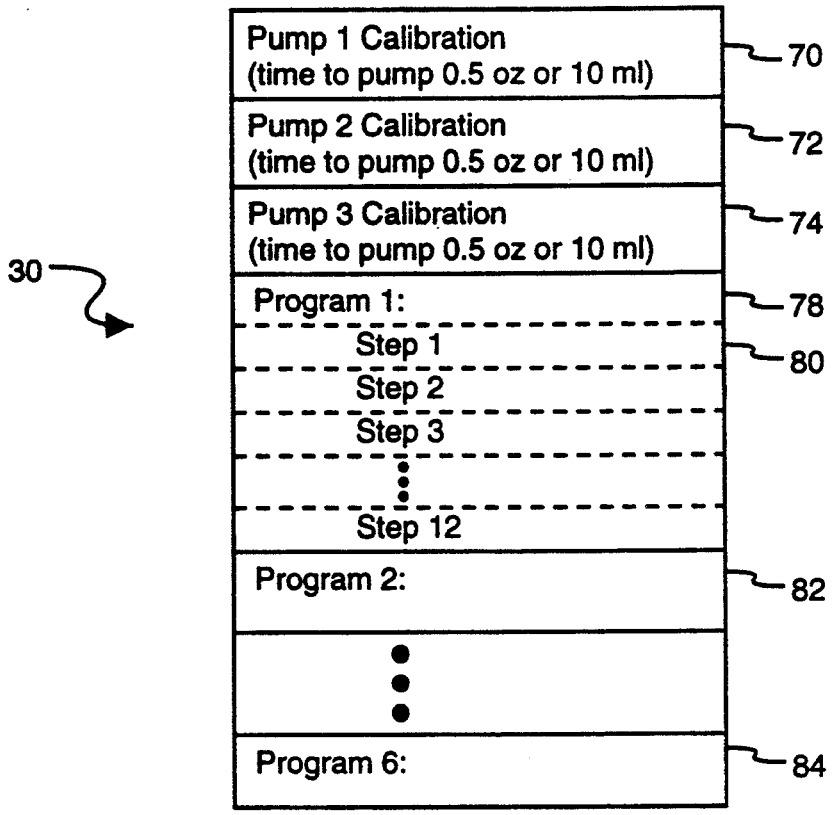
FIG. 2 depicts a compact memory scheme for storing pump calibration information and chemical dispensing programs in accordance with the invention.

FIG. 2 provides a depiction of a compact memory scheme that may be used for the liquid dispensing programs 30. In particular, the figure depicts a 78 byte region of an EEPROM, with 8-bit bytes. The EEPROM includes two bytes of memory space 70 for Pump 1 calibration information. The time calibration period, previously established, will be stored in this space. More particularly, the stored two-byte pump calibration value represents a time value in units of 0.25 second, with a maximum value of 512 seconds (8.53 minutes) as represented by an integer value of 2048 ($0200_H$). When running a stored dispensing program, the controller runs each pump for a period of time defined as follows:

$$\text{PumpRunTime} = \text{CalibTime} \times 0.025\ \text{sec} \times \text{ProgrammedQuantity}$$

where the "ProgrammedQuantity" is the number of chemical calibration units set by the user (in the program step being run), the "0.025 sec" is equal to one tenth the time unit used for manual calibration, and "CalibTime" is the calibration time stored for the pump.

Time calibration periods are also stored in the next four bytes (two bytes for Pump 2 calibration 72 and two bytes for Pump 3 calibration 74). Thus, six bytes are used to store pump calibration values.

In one embodiment of the invention, the EEPROM in memory 24 stores six dispensing programs, with twelve bytes used for each dispensing program. FIG. 2 depicts Program 1 being stored in memory region 78, which includes twelve program steps 80, each being represented by one program byte. FIG. 2 also shows Program 2 (82) through Program 6 (84) being stored in sequentially ordered memory regions.

Figure 3:
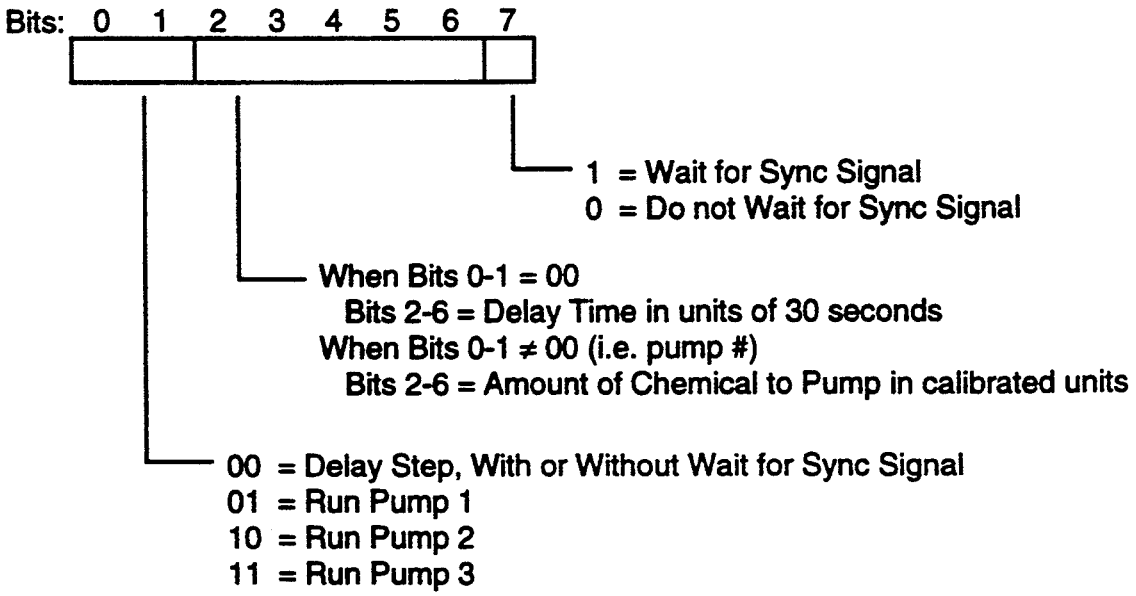
FIG. 3 depicts the data used to represent one program step in accordance with the invention.

As is more fully appreciated with reference to FIG. 3, each byte within a program can store a step or an instruction to be executed. In one embodiment of the invention, the first two bits are used to store delay and dispense flags. If the first two bit values are "00", then a delay step is invoked. The amount of time to be delayed is established by the following 4 bits (bits 2–6), which store a time delay count, in units of thirty seconds, as previously described. Relying upon the previous example, the time delay count was 4, so the stored value in bits 2–6 would be "0100". This value is later multiplied by the time delay unit of thirty seconds to establish a delay period of two minutes.

If the first two bits am a value other than "00", then the dispense state is invoked for a particular pump. The amount of chemical to be dispensed, measured in chemical calibration units, is stored in the following 4 bits (bits 2–6). Recall that this volume amount was entered by the user. In the example provided, 3 ounces were desired. This value corresponded to 6 LED flashes, or 6 chemical calibration units. Thus, the value stored in bits 2–6 would be "0110".

The last bit position is reserved for a sync signal flag. As previously indicated, if the sync command is activated, the chemical dispenser control apparatus of the invention will wait for the flow sensor 64 to indicate that the tub of the machine 56 has been emptied.

Figure 4:
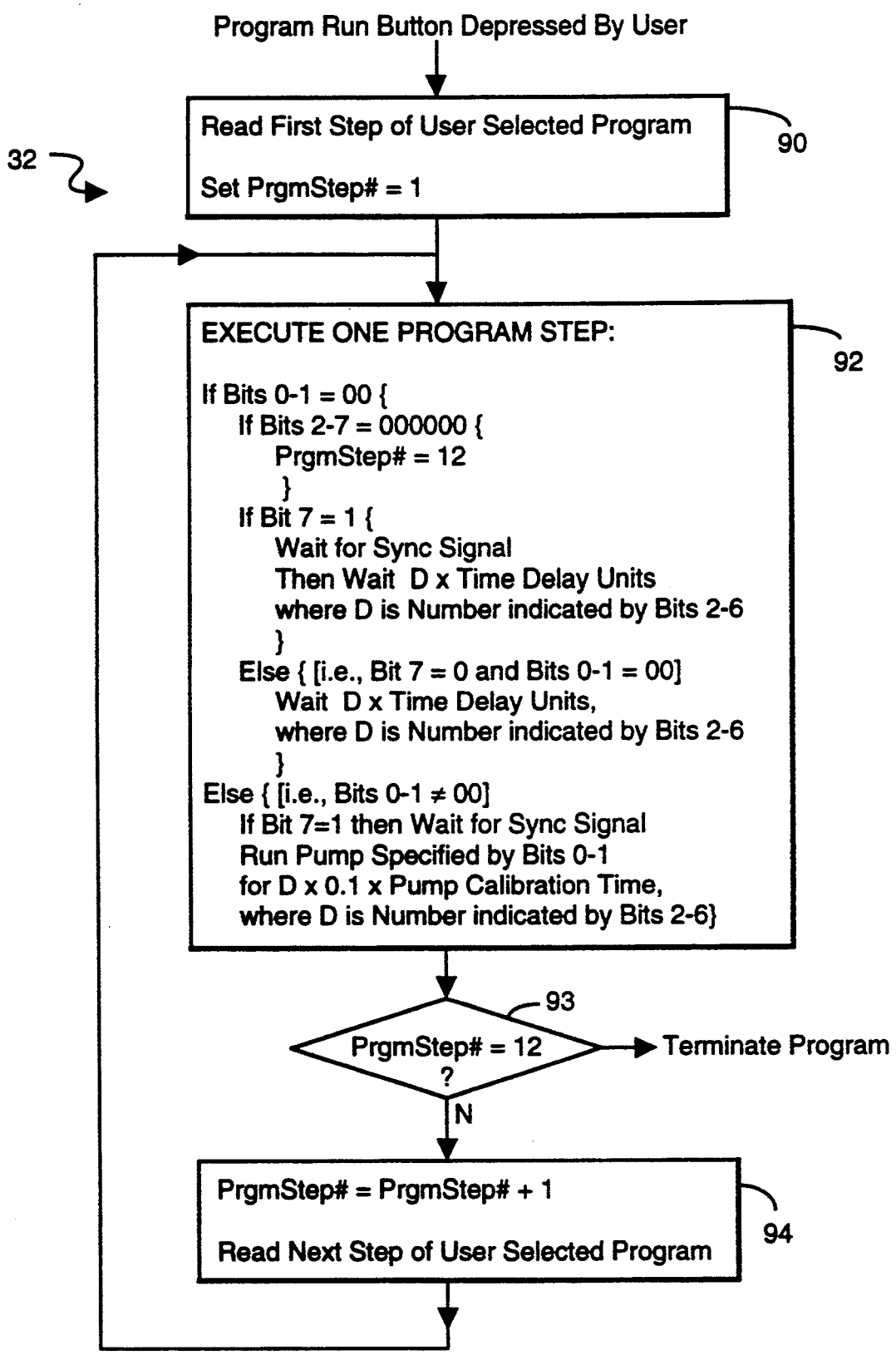
FIG. 4 depicts a program for executing the pump calibration commands and chemical dispensing programs of the invention.

The significance of each liquid dispensing program byte is more fully appreciated with reference to FIG. 4, which depicts a program execution module 32 in accordance with the invention. The program execution module may be invoked after the liquid dispensing program 30 is established in the manner previously described.

The liquid dispensing program is activated by pressing one of the program buttons, for instance the button Pgm 1. This causes the microcontroller 22 to read the first byte of the program and to initialize a program step counter (see block 90). A program step execution routine is then invoked (block 92). The first two bits of the byte are examined to determine whether the delay cycle is invoked. If the delay cycle is invoked, the remaining bits are examined to determine the appropriate action. If the remaining bits are empty, this indicates that there are no more instructions associated with the program, thus the program may be terminated. This may be done by setting the PrgmStep# value to 12. If a non-zero value is found in the remaining bits, one of two actions is taken. If the last bit is set to "1", then the microcontroller 22 waits for the sync signal from the flow sensor 64. After this signal is received, a delay period is invoked. The delay period corresponds to the time delay count value found in bits 2–6 multiplied by the assigned time delay unit value, for example thirty seconds. If the last bit is not set to "1", then the delay period is immediately measured in the described fashion.

If the first two bits of the program step have a non-zero value, this indicates that a dispense cycle for one of the pumps is being invoked. For instance, if the binary value "01" is found in the first two bits, the following bits define how much liquid chemical the first pump should dispense. In particular, the bits 2–6 store the number of chemical calibration units to be dispensed. The microcontroller 22 uses the stored pump calibration time to convert this volume amount to a time period for which the first pump is to operate. In the example provided above, the first pump required ten seconds to dispense five ounces of liquid chemical. This calibration value is multiplied by 0.1 and by the chemical unit count to yield a time period for the first pump to run.

Note that if the synchronization bit is set (bit7=1), then a wait state is invoked until a synchronization signal is received. The synchronization bit will be set in dispense commands primarily in the case of a washer that is synchronized at the intake 60 to the washer. That is, when the flow sensor 64 is coupled to the water intake 60, dispensing steps may be synchronized with water inflows by setting the synchronization bit, but the synchronization bit will generally not be used in dispense commands when the flow sensor 64 is at the washer's drain port.

After the program step execution routine finishes performing one program step, a check is made to determine whether the final program step has been completed (step 93). If so, program execution module completed. Otherwise, the PrgmStep# value is increased, the next byte (or step) of the liquid dispensing program is read (step 94), and then the next program byte is interpreted by step 92, as described above.

The foregoing information is more clearly appreciated with a more detailed example. The following wash cycle is to be programmed:

1. Delay two minutes to fill the washer
2. Dispense 6.5 ounces of detergent (Pump 1)
3. Wait for the flow sensor to indicate that the tub is emptied
4. Delay two minutes to fill the washer
5. Dispense 4.5 ounces of bleach (Pump 2)
6. Wait for the flow sensor to indicate that the tub is being emptied
7. Delay two minutes for the washer to fill
8. Dispense 3.5 ounces of soft/sour treatment (Pump 3)

To program this sequence of events, while using the chemical calibration unit value and time delay unit value previously described, the following steps would be taken at the operator interface 26:

1. Press Program button until LED is on
2. Press Pgm 1 button
3. Press Delay button, count 4 LED flashes, and re-press Delay button (time delay unit value of 30 seconds times 4 equals two minutes)
4. Press Pump 1 button, count 13 flashes, and re-press Pump 1 button (chemical calibration unit value of 0.5 ounces times 13 equals 6.5 ounces)
5. Press Sync button
6. Press Delay button, count 4 LED flashes, and re-press Delay button
7. Press Pump 2 button, count 9 LED flashes, and re-press Pump 2 button
8. Press Sync button
9. Press Delay button, count 4 LED flashes, and re-press Delay button
10. Press Pump 3 button, count 7 LED flashes, and re-press Pump 3 button
11. Press Pgm 1 button After programming the liquid chemical dispenser control apparatus 20 in the manner described, the sequence of commands will be executed by merely pressing the Pgm 1 button. It is desirable to provide a program review feature which does not require actual execution of the dispensing programs. Therefore, the microcontroller is programmed to interpret a combination of button pushes as a review command. Pushing the Pgm 1 button and the Sync button commands the microprocessor to execute a review program 95 that reviews the installed program by flashing the LEDs so as to indicate the stored program steps. For example, in view of the foregoing instructions, the review program 95 would produce the following actions:

1. Delay LED-4 flashes
2. Pump 1 LED-13 flashes
3. Sync LED-1 flash
4. Delay LED-4 flashes
5. Pump 2 LED-9 flashes
6. Sync LED-1 flash
7. Delay LED-4 flashes
8. Pump 3 LED-7 flashes
9. Pgm 1 LED-1 flash A program can be modified by complete reprogramming of the program. One can check the calibration of a particular pump by pressing the pump button, without pressing the program button, and measuring the resultant volume dispensed. If the volume dispensed is not equivalent to the chemical calibration volume, the Program button should be pushed, the Pump 1 button should be pushed, and then the Pump 1 button should be re-pushed when the chemical calibration volume is dispensed. This procedure will establish a new time calibration period.

Any number of devices may be used for the flow sensor 64. For instance, a pressure sensitive switch may be used to provide an activation signal identifying the termination of the flow of draining water. Preferably, the switch will require an "ON" signal of approximately five seconds to avoid false input, and an OFF constant of approximately five minutes will be provided between activation signals, again to avoid false activation of the switch.

As previously stated, the liquid dispensing programs 30 are preferably stored in an EEPROM within the memory unit 24. The microcontroller 22 is preferably a low cost device such as the PIC16C57XT, an eight-bit microcontroller from Microchip, Inc., Chandler, Ariz.

Figure 5:
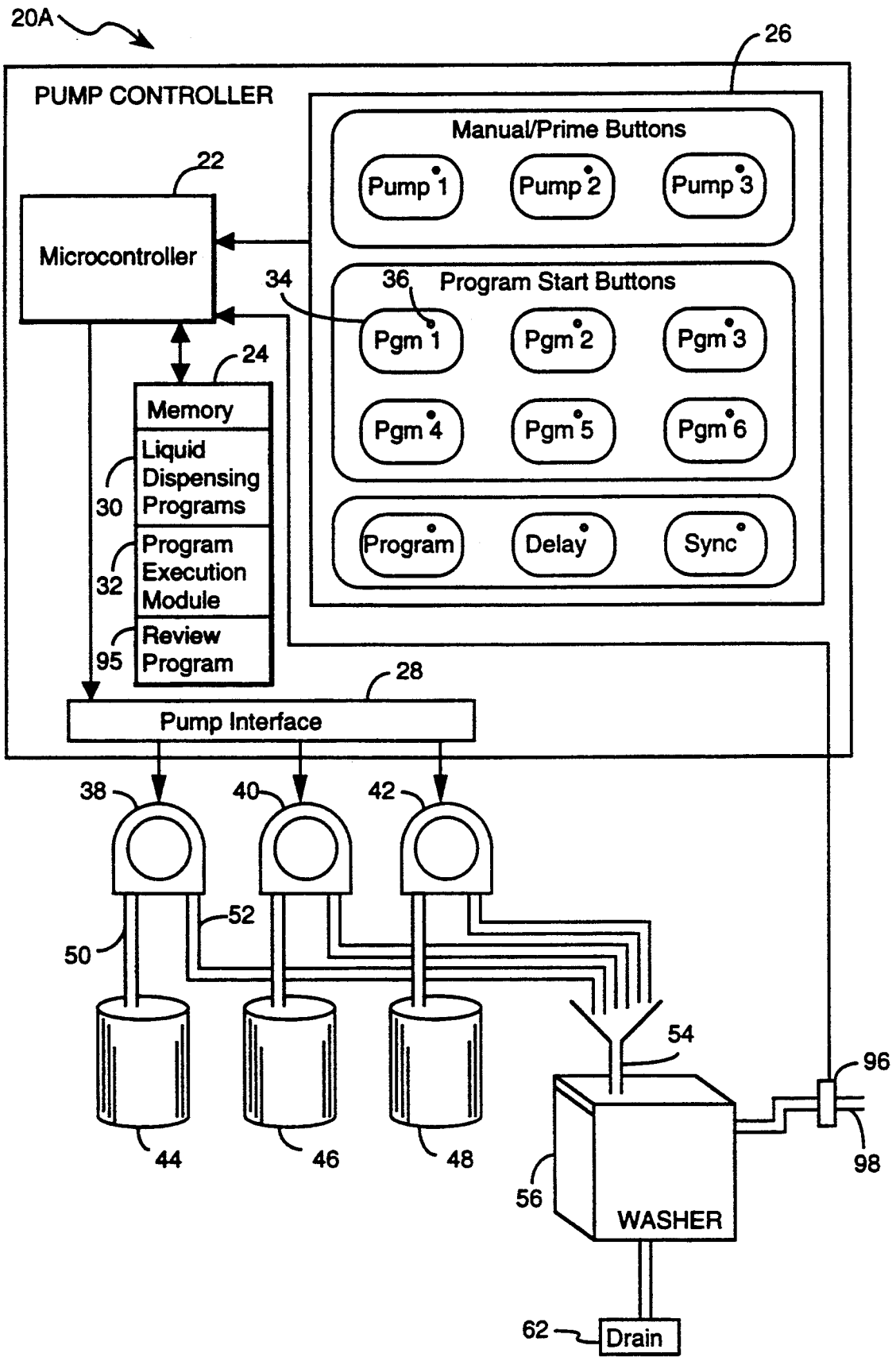
FIG. 5 is an alternate embodiment of the liquid chemical dispensing apparatus of the invention; in particular, the alternate embodiment employs a synchronization signal actuator positioned at the water supply source, instead of the drain.

FIG. 5 shows an alternate embodiment of the present invention. The liquid chemical dispenser control apparatus 20A of the figure receives a synchronization signal from a sensor 96 positioned on the water intake supply line 98. Laundry machines in Europe typically have a single intake supply line 98. In this embodiment, the synchronization signal may be derived from electrical drive voltage signals associated with solenoid valves opening and closing the intake supply line.

Figure 6:
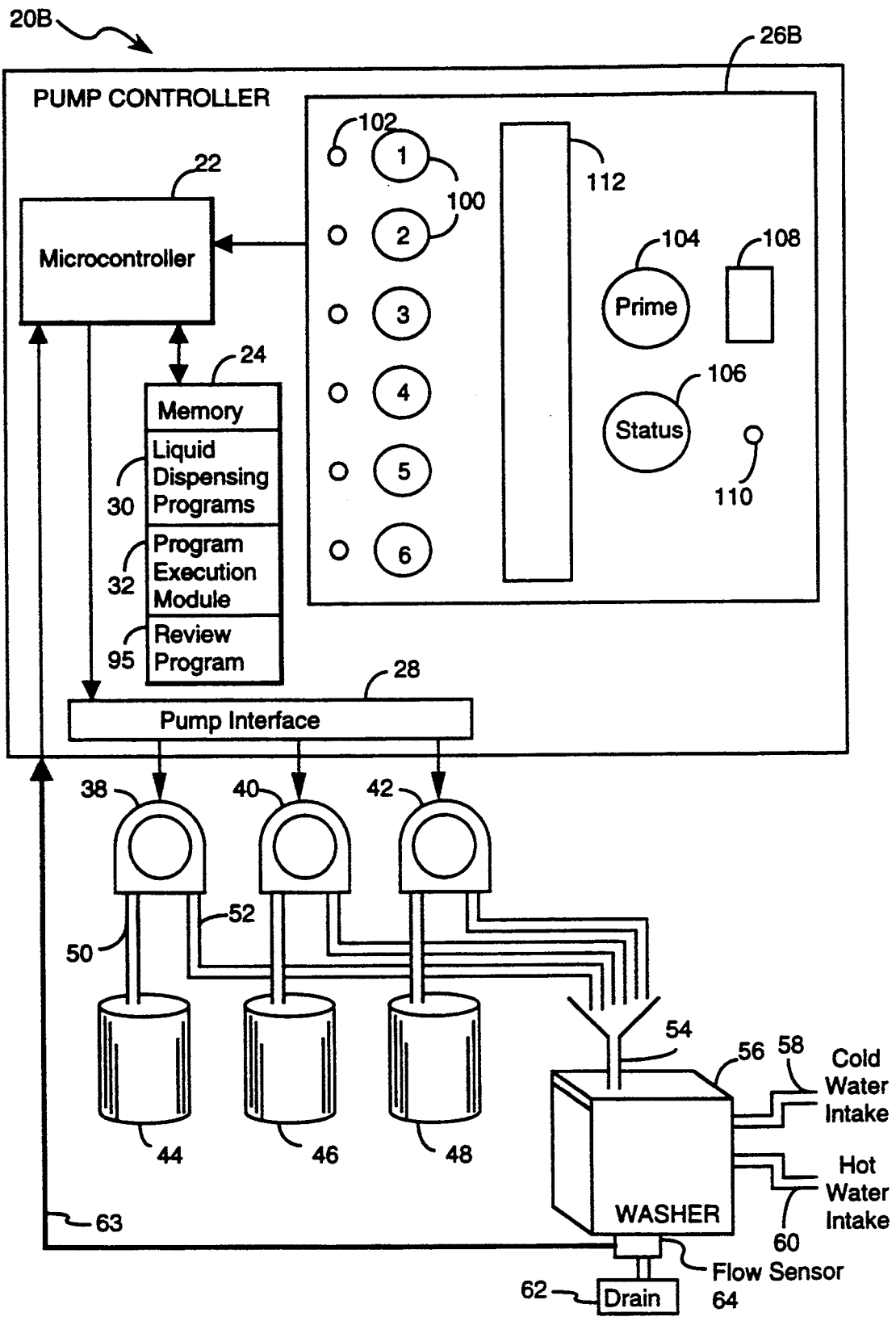
FIG. 6 is an alternate embodiment of the liquid chemical dispensing apparatus of the invention that utilizes a different operator interface. Like reference numerals refer to corresponding parts throughout the several views of the drawings.

FIG. 6 shows another embodiment of the present invention that uses a different operator interface 26B. The operator interface 26B includes a set of schedule buttons 100 that are positioned next to a set of schedule LEDs 102. The interface 26B also includes a prime button 104 and a status button 106. Adjacent to the prime button 104 is a number display 108 and adjacent to the status button 106 is a status LED 110. Information card 112 may be used for written programming instructions for the unit.

The operator interface 26B is used to load liquid dispensing programs 30 of the type previously described. The program execution module 32 will execute the liquid dispensing programs 30 in the manner previously described.

The following text describes an example of the sequence of programming and execution steps that may be used with the operator interface 26B. To program the apparatus 20B, one initially presses the prime button 104 on operator interface 26B. This operation causes the interface 26B to display the number "1" on the number indicator 108. Afterwards, one of the schedule buttons 100 is pressed to indicate the total number of programs to be entered.

After the total number of programs is entered, auxiliary data is entered by once again pressing the prime button 104. This operation causes the interface 26B to display the number "2" on the number indicator 108, and thereby indicate that a different programming mode has been entered. The auxiliary data is used to select the type of signal from the flow sensor 64. In particular, the person programming the controller 20B presses schedule button "4" to toggle the LED next to button "4" to indicate the type of flow sensor being used: if the flow sensor produces an enabled signal (for instance, the presence of an optical signal or a voltage for opening a solenoid valve) on line 63 when the drain valve of the washer is open, the schedule button "4" is pressed until the LED next to that button is "on"; if the flow sensor produces an enabled signal when the drain valve is closed, the schedule button "4" is pressed until the LED next to that button is "off".

By pressing the prime button 104 once again (producing the number "3" on the number indicator 108), the programming mode for storing predefined parameter data is be entered. For example, a filter parameter may be defined for the flow sensor signal. For example, by pressing the schedule button number 1, a long signal of fifteen seconds may be required on line 63 before any subsequent action is taken. This selection may be identified by lighting the schedule LED 102 corresponding to the first schedule button 100. To provide for a short signal, say two seconds, on line 63 before any subsequent action is taken, then the first schedule button number 1 may be pressed again, causing the corresponding schedule LED 102 to turn off.

After auxiliary data is entered, the programming mode for calibration of the pumps is entered by pressing the prime button 104 and then the status button 106. This operation causes the interface 26B to display the number "4" on the number indicator 108, again to indicate that a new program mode has been entered.

Afterwards, a schedule button 100, that corresponds to the pump number to be primed, is pressed. This commences the pumping operation for the respective pump. The desired amount to be pumped should be measured, as previously described. After the desired amount is measured, the same button should be pressed to stop the pump. The same procedure is then used for the remaining pumps.

To enter the program mode, the prime button 104 is pressed once again. To enter the first program, the status button 106 is pressed and then the prime button 104 is pressed. After this sequence of commands, the number display 108 displays the number "1", indicating that the first program is being entered. To input the appropriate delay period, a designated schedule button 100 is pushed, say button 6. This causes the corresponding LED to flash once for every thirty seconds of delay. After the desired delay has been indicated by the flashing LED, the designated schedule button is pushed again.

To input the appropriate pump run time, a designated schedule button is pushed. The corresponding schedule LED will then flash one time for each calibration amount. After the desired calibration amount has been indicated by the flashing LED, the designated schedule button is pushed again.

To input the appropriate wait period, the status check button 106 may be pressed. The status LED 110 will then flash one time for each selected wait period. The status check button 106 is pressed again after the proper period has been counted by the status LED 110.

To confirm that the program has been entered correctly, the prime button 104 may be pressed once again. This action is followed by pressing schedule button 1 to play back the program associated with the button. The programmed LEDs will then play back in the manner previously described. The program may be overwritten by pressing the status button 106 and then pressing the prime button 104. To proceed to another program, the prime button 104 is pressed. Thereafter, the previously described programming steps are performed.

The foregoing explanation of the operator interface programming sequence is associated with an operative embodiment of the invention. One skilled in the art will recognize an unlimited variety of modifications of the described programming sequence. Therefore, the invention should not be construed as being limited to the programming examples provided herein.

One skilled in the art will recognize a number of advantages associated with the present invention. First, the liquid dispensing programs may be compactly stored in a small amount of memory. Similarly, the liquid dispensing program may be efficiently executed by the program execution module, using minimal computing power. The operator interface is a compact, relatively inexpensive unit which is easy to program. A chemical calibration unit is defined for convenient programming. Time delay units are also used to facilitate the programming task. The invention does not rely upon an expensive sequence controller connection, as required in the prior art.

The foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following Claims and their equivalents.

What is claimed is:

1. An apparatus for dispensing liquid chemicals into a laundry machine, said apparatus comprising;

a synchronization signal receiver that receives synchronization signals from a sensor that detects water flows associated with operation of said laundry machine;

a memory unit storing a liquid dispensing program that includes a sequence of program steps, said program steps including chemical volume dispensing information and synchronization instructions to wait for ones of said synchronization signals;

an interface that receives a start program execution signal;

a logic circuit coupled to said memory unit, said synchronization signal receiver, and said interface that executes said liquid dispensing program when said interface receives said start program execution signal; said logic circuit generating pump activation commands based upon said chemical volume dispensing information, and waiting for a next one of said received synchronization signals before executing program steps having synchronization instructions; and a pump interface coupled to said logic circuit to receive said pump activation commands, said pump interface activating a plurality of liquid chemical dispensing pumps in accordance with said pump activation commands to dispense liquid chemicals from supplies thereof into said laundry machine.

2. The apparatus of claim 1, said interface further including an operator interface for programming said liquid dispensing program.

3. The apparatus of claim 2 wherein said memory unit is an EEPROM.

4. The apparatus of claim 1 wherein said sensor is positioned at the drain of said laundry machine and generates a synchronization signal upon water outflow from said laundry machine.

5. The apparatus of claim 1 wherein said sensor is positioned at a water intake of said laundry machine so as to generate a synchronization signal when water flows into said laundry machine.

6. The apparatus of claim 1 wherein said logic circuit individually processes each step of said liquid dispensing program by identifying an action and by executing said action for a time period specified by said each step.

7. The apparatus of claim 1 wherein said program steps stored in said memory unit include cycle delay information and said logic circuit delays program steps for delay periods corresponding to said cycle delay information.

8. An apparatus for dispensing liquid chemicals into a laundry machine, said apparatus comprising:

a pump interface for receiving pump activation commands, said pump interface being coupled to a plurality of pumps, said pumps responding to said pump activation commands to dispense liquid chemicals from containers into said laundry machine;

a sensor for generating a synchronization signal;

an operator interface including a plurality of programming/execution buttons;

a memory unit for storing a liquid dispensing program defined by said programming/execution buttons of said operator interface, said liquid dispensing program including chemical volume dispensing information and synchronization instructions;

a microcontroller coupled to said pump interface, said sensor, said operator interface, and said memory unit, said microcontroller including means for generating said pump activation commands from said chemical volume dispensing information in said stored liquid dispensing program, and means for responding to said synchronization signal in accordance with said synchronization instructions in said stored liquid dispensing program.

9. The apparatus of claim 8 wherein said memory unit stores cycle delay information and said microcontroller includes means for establishing a time delay period based upon said cycle delay information.

10. The apparatus of claim 8 wherein said operator interface includes manual/prime buttons, program buttons, and program input buttons.

11. The apparatus of claim 10 wherein said manual/prime buttons are used to calibrate an amount of liquid to be dispensed by one of said plurality of pumps.

12. The apparatus of claim 10 wherein said program buttons are used to program and initiate execution of said stored liquid dispensing program.

13. The apparatus of claim 12 wherein said program input buttons are used to define a delay state and a synchronization state for said stored liquid dispensing program.

* * * * *